US010619335B2

(12) United States Patent
Zoller

(10) Patent No.: US 10,619,335 B2
(45) Date of Patent: Apr. 14, 2020

(54) SANITARY INSERT UNIT

(75) Inventor: Uwe Zoller, Teningen (DE)

(73) Assignee: Neoperl GmbH, Mullheim (DE)

( * ) Notice: Subject to any disclaimer, the term of this patent is extended or adjusted under 35 U.S.C. 154(b) by 1991 days.

(21) Appl. No.: 13/190,402

(22) Filed: Jul. 25, 2011

(65) Prior Publication Data

US 2011/0278380 A1 Nov. 17, 2011

Related U.S. Application Data

(63) Continuation-in-part of application No. 11/863,601, filed on Sep. 28, 2007, now abandoned, which is a continuation of application No. 10/547,204, filed as application No. PCT/EP2004/002504 on Mar. 11, 2004, now abandoned.

(30) Foreign Application Priority Data

Mar. 21, 2003 (DE) ..... 103 12 854

(51) Int. Cl.
*E03C 1/08* (2006.01)
*E03C 1/02* (2006.01)

(52) U.S. Cl.
CPC ..... *E03C 1/08* (2013.01); *E03C 2001/026* (2013.01)

(58) Field of Classification Search
CPC ..... E03C 2001/026; E03C 1/08
USPC ..... 239/106, 428.5, 523, 553, 553.5, 575, 239/DIG. 23; 210/449
See application file for complete search history.

(56) References Cited

U.S. PATENT DOCUMENTS

| | | | | |
|---|---|---|---|---|
| 3,104,819 | A | 9/1963 | Aghnides | |
| 3,216,451 | A | 11/1965 | Smallpeice | |
| 4,000,857 | A | 1/1977 | Moen | |
| 4,313,564 | A * | 2/1982 | Shames et al. | 239/110 |
| 4,470,546 | A | 9/1984 | Wildfang | |
| 4,562,960 | A * | 1/1986 | Marty et al. | 239/72 |
| 4,657,186 | A * | 4/1987 | Shapiro | 239/462 |
| 4,730,786 | A | 3/1988 | Nelson | |
| 5,769,326 | A | 6/1998 | Muchenberger et al. | |
| 6,695,011 | B2 | 2/2004 | Sochtig | |
| 2002/0084353 | A1 | 7/2002 | Griffin et al. | |
| 2003/0141384 | A1 | 7/2003 | Grether et al. | |

(Continued)

FOREIGN PATENT DOCUMENTS

| | | |
|---|---|---|
| DE | 3440883 A1 | 5/1986 |
| DE | 3642356 A1 | 6/1988 |
| DE | 3835559 A1 | 4/1990 |

(Continued)

*Primary Examiner* — Jason J Boeckmann
(74) *Attorney, Agent, or Firm* — Robinson & Cole LLP; John L. Cordani

(57) ABSTRACT

A sanitary unit (1) is provided, which is configured for insertion into a discharge fitting. The sanitary unit (1) includes an upstream sieve (2) and a throughflow regulator (3), which includes a control gap (10) and a throttle body (8) that deforms under pressure to regulate throughflow varying the control gap (10). The sanitary unit (1) also includes a jet fractionating plate (4), having a plurality of axial openings (20) in a throughflow direction positioned downstream, in a flow direction, from the throughflow regulator (3) and the sieve, the throughflow regulator (3) is arranged within an interior space (6) between the sieve (2) and the jet fractionating plate.

12 Claims, 3 Drawing Sheets

(56) References Cited

U.S. PATENT DOCUMENTS

2006/0273203 A1 12/2006 Denzler

FOREIGN PATENT DOCUMENTS

WO 0196673 A1 12/2001
WO WO 0196673 A1 * 12/2001

* cited by examiner

SANITARY INSERT UNIT

CROSS-REFERENCE TO RELATED APPLICATIONS

This application is a continuation-in-part of U.S. application Ser. No. 11/863,601, filed Sep. 28, 2007, which is continuation of U.S. application Ser. No. 10/547,204, filed Aug. 26, 2005, which was a 371 National Phase of PCT/EP2004/02504, filed Mar. 11, 2004, the entire contents of all of which are incorporated by reference herein as if fully set forth.

BACKGROUND

The invention relates to a sanitary insert unit, which can be inserted into a discharge fitting, comprising an essentially conical-shaped upstream sieve with a downstream throughflow regulator and a jet regulator located further downstream in the direction of the flow.

Sanitary insert units of the type mentioned at the outset have been known in various embodiments. Such insert units are regularly inserted into a discharge mouthpiece, which is mounted in a detachable manner in a sanitary discharge fitting. With the aid of such insert units, a homogenous, soft, and non-splashing water jet is formed.

Such insert units, comprising an upstream throughflow regulator and a downstream jet regulator, can result in mounting problems due to their construction size. In particular, the retrofitting into such discharge fittings is problematic, which had previously been operated with an insert unit comprising no throughflow regulators but a jet regulator only, because the latter insert unit has a lower construction height than the insert unit with a throughflow regulator.

SUMMARY

Thus, the object is to provide a jet regulator or sanitary insert unit of the type mentioned at the outset, in which the mounting problems based on the construction height are avoided even in environments with limited space.

The object is attained according to the invention in particular in that the throughflow regulator is essentially arranged within the interior space of the insert unit limited at its top by the upstream sieve.

Thus, the previously unused interior space below the upstream sieve of insert units known is practically used for the throughflow regulator, so that the construction height of the insert unit according to the invention with the throughflow regulator requires little or no increase in reference to the construction height of a conventional insert unit.

In this way, a hundred per cent geometrical compatibility of two such insert units is realized so that any mutual exchange of the insert units or the optional retrofitting of the throughflow regulator is possible without any problems.

The insertion of the throughflow regulator into the interior space limited by the upstream sieve can occur in a particularly efficient manner, when the throughflow regulator is provided with a cross-sectional profile essentially shaped corresponding to the profile of the upstream sieve.

Over time, the upstream sieve can become clogged by contaminants or calcium deposits. In order to ensure sufficient water flow even in upstream sieves partially clogged in their central area it is advantageous for the throughflow regulator to be provided with a sloping surface rising radially upward at an exterior, in particular circular edge region, which leads to a throughflow opening connected to a control gap or the like, provided with the jet regulator, and for the rising sloping surface and the upstream sieve to be distanced from one another.

This way, inflowing water can be fed from the exterior region of the upstream sieve via the rising sloping surface to the throughflow regulator and, subsequently, to the jet regulator. This ensures the functionality of the insert unit according to the invention even with a partially clogged upstream sieve.

In order to achieve a defined flow of water to the throughflow regulator via the rising sloping surface and to avoid turbulence in the circumferential direction, it is useful for the rising sloping surface to be provided on its upper side with approximately radially aligned grooves to form individual inflow channels. Through the bundled water flow in the feeding channels, the inflow speed can be increased at the throughflow regulator, and subsequently at the jet regulator as well, so that the functionality of the insert unit is improved.

It is advantageous for the bars located between the grooves to end close to or at the interior side of the upstream sieve and to serve as support elements for said upstream sieve. This way, the bars form supports for the upstream sieve so that the stability of the arrangement is improved and an undesired deformation of the upstream sieve, for example by excessive pressure of the inflowing water, can be avoided.

In order to enable steady water influx it is useful for the bars of the rising sloping surface to be distanced from one another in regular intervals in the circumferential direction.

One preferred embodiment of the insert unit according to the invention includes the throughflow regulator being provided with a central core region, which is surrounded by a circular throttle body, and that between the throttle body and the rising sloping surface a control gap is formed, with the cross-section of its opening being adjustable by the throttle body deforming under the pressure difference developing by the throughflow.

BRIEF DESCRIPTION OF THE DRAWINGS

An exemplary embodiment of the insert unit according to the invention is explained in greater detail in the following drawings where.

DETAILED DESCRIPTION OF THE PREFERRED EMBODIMENTS

Figure 1:
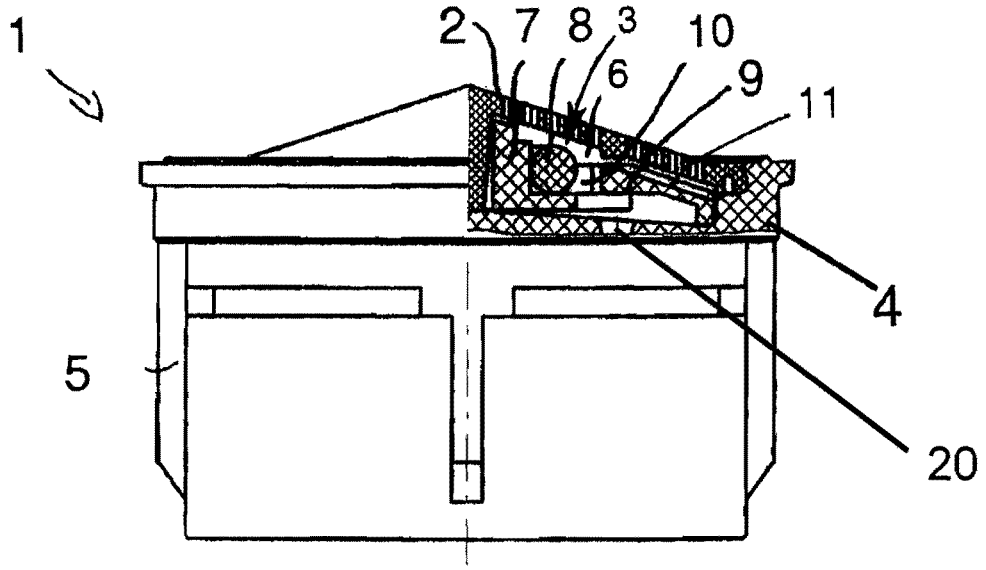
FIG. 1 is a side view of an insert unit according to the invention, partially in cross-section.
Figure 3:
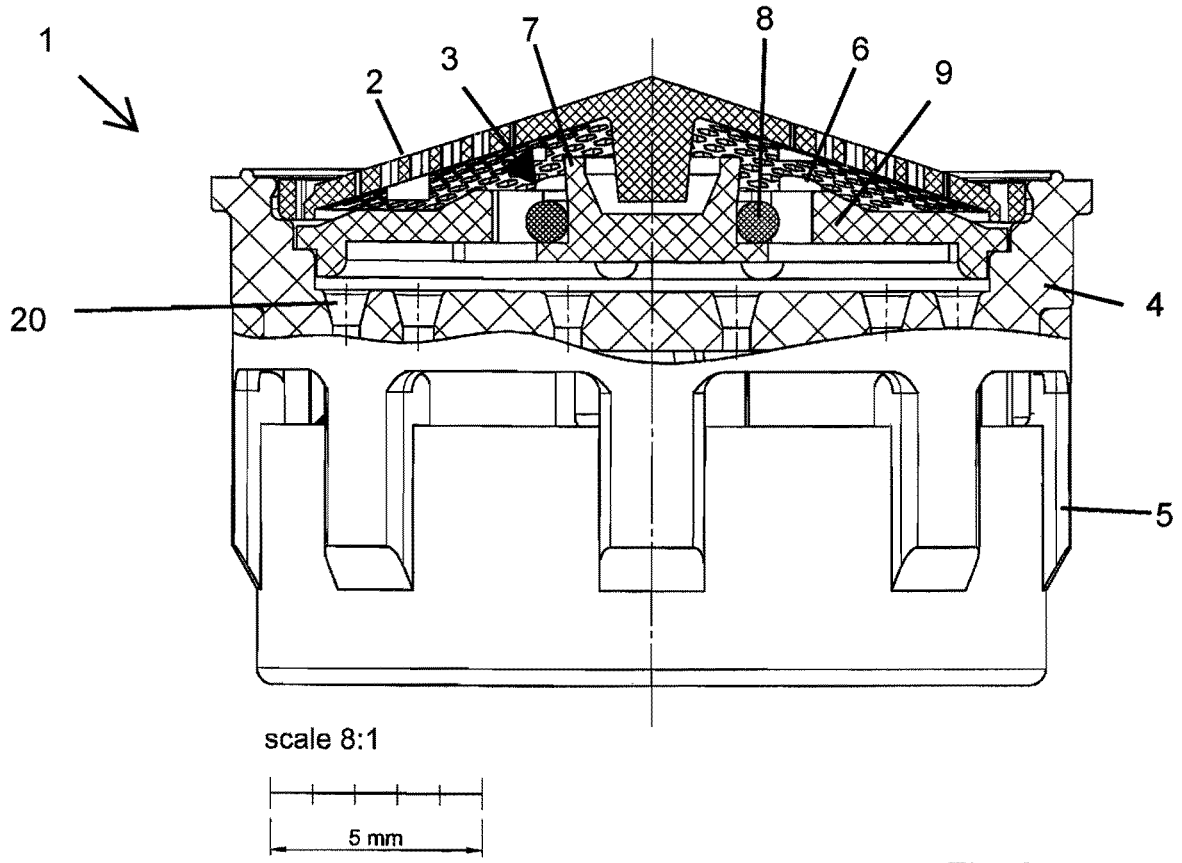
FIG. 3 is a side view, shown to scale, of an insert unit according to the invention, partially in cross-section.
Figure 4:
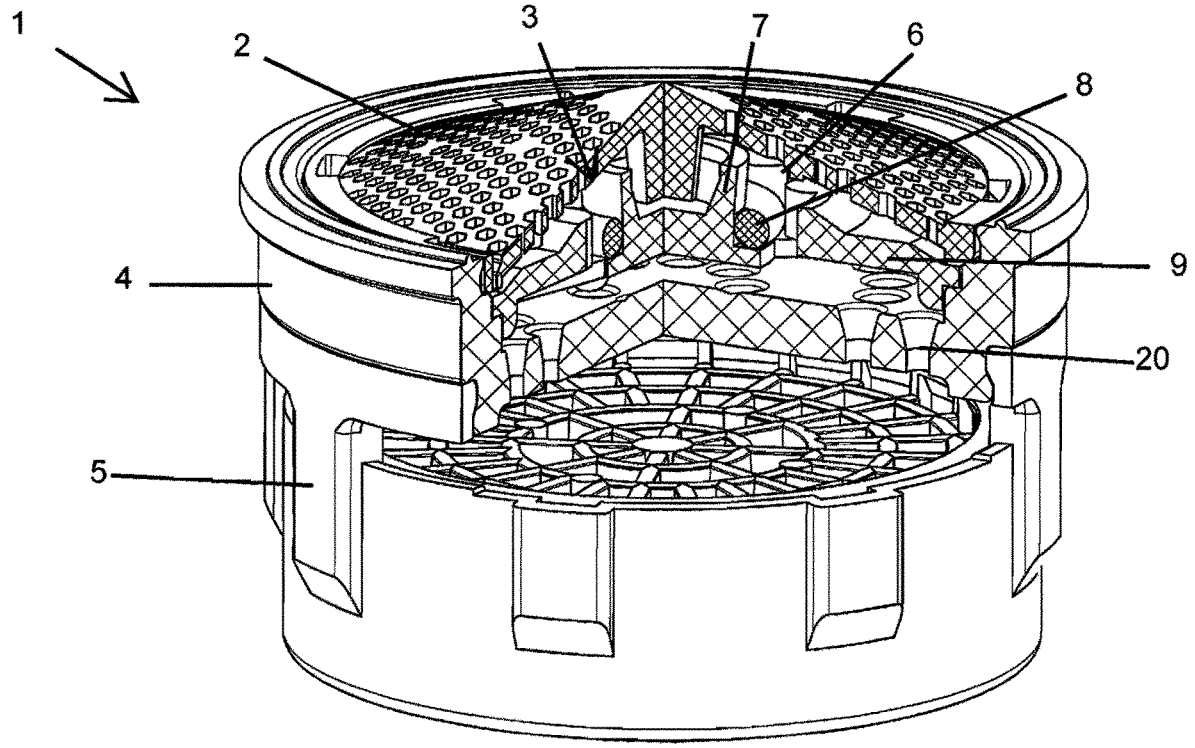
FIG. 4 is a perspective view of an insert unit according to the invention, partially in cross-section.

As shown in FIGS. 1, 3 and 4, a jet regulator or sanitary insert unit, marked 1 in its entirety, is provided with an upstream sieve 2, a throughflow regulator 3, and a jet fractionating plate 4, detachably connected to one another via its housing 5.

FIGS. 1 and 3 show a side view of the insert unit 1 partially in a cross-section with FIG. 4 being a perspective view. Below the upstream sieve 2, formed essentially cone-shaped, an interior space 6 is formed, in which the throughflow regulator 3 is arranged. The throughflow regulator 3 is provided with a central core region 7, which is surrounded by a circular throttle body 8. Between the throttle body 8 and a radially, inwardly rising sloped surface 9 a control gap 10 is formed in the exterior edge region of the throughflow regulator 3, which is in throughflowing connection to the jet fractionating plate 4, which comprises a plurality of axial openings 20 in a throughflow direction located therebelow. The upstream sieve 2 is connected to the jet fractionating plate 4, for example by a snap fit. As shown in FIGS. 1, 3 and 4, the throughflow regulator 3 is arranged in the interior space 6 in such a way that the sieve 2 keeps it in place in the interior space 6.

The central core region 7, the throttle body 8, and the rising sloping surface 9 are sized such that the cross-sectional profile of the throughflow regulator 3 is substantially form-fitting to the cross-sectional profile of the upstream sieve 2, with the rising sloping surface 9 and the upstream sieve 2 being distanced from one another. As discernable from FIG. 3, which is shown to scale, the ratio of the overall height of the insert unit 1 to the height of the interior space 6 is approximately 3:1. This ratio, which can also be varied, allows a throughflow regulator 3 to be used in an insert unit that was previously unable to accommodate throughflow regulator due to height restrictions. Moreover, the housing 5 can maintain its height, which provides aeration of water flowing through the insert 1, without requiring housings having different heights when incorporating a throughflow regulator.

Due to the arrangement of the throughflow regulator 3 inside the interior space 6 formed below the upstream sieve 2 an insert unit 1 results with, in reference to conventional insert units, a reduced construction height and/or with the ability to realize a construction height for an insert unit housing a throughflow unit, which previously was only possible for insert units without any throughflow regulators. This is particularly evidenced by FIG. 3, which is to scale, and generally shows that the overall height of the insert unit being generally 3 times the maximum height of the interior space 6. Thus, the insert unit 1 according to the invention can be easily integrated in environments, in which previously known jet regulators without any throughflow regulators had been used or which are provided with limited space available.

Figure 2:
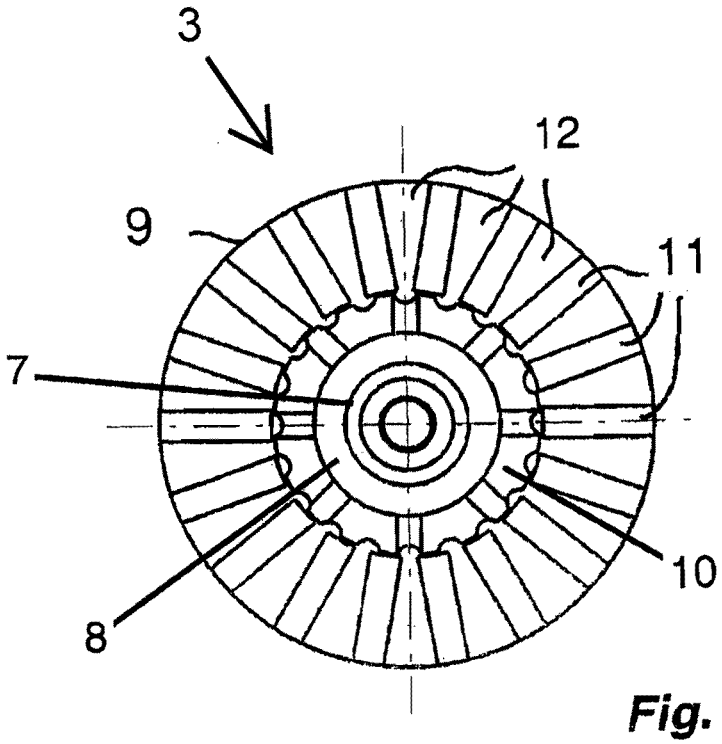
FIG. 2 is a top view of the throughflow regulator of an insert unit according to the invention.

As particularly discernible in FIG. 2, the rising sloped surface 9 is provided at its upper side with rinsing grooves or the like 11, extending radially and equally spaced apart from one another, in order to form individual influx channels. These influx channels allow a controlled incoming flow of water, which enters the throughflow regulator 3 through the area of the upstream sieve 2 above rising sloping surface 9, towards the control gap 10. This way, even in the case of a sectional clogging of the upstream sieve 2 in the central region, for example by contaminants in the inflowing water or by calcium deposit, sufficient water flow from the exterior region is ensured into the control gap 10 and subsequently into jet fractionating plate 4.

The bars or protrusions 12 positioned between the grooves 11 and limiting them end in proximity to the interior side of the upstream sieve 2. This way, they can serve as support elements for the upstream sieve 2, in order to improve the stability of the insert unit 1 and to prevent an undesired deformation of the upstream sieve 2 into the interior space 6, for example by excessive pressure of the inflowing water or by the handling during the mounting process of the insert unit 1.

The invention claimed is:

1. A sanitary unit (1), configured for insertion into a discharge fitting, comprising:

a conical upstream sieve (2) having an inner surface and an outer surface;

a throughflow regulator (3), immediately adjacent the sieve (2), comprising a control gap (10) and a throttle body (8) that deforms under pressure to regulate throughflow varying the control gap (10);

a jet fractionating plate (4), immediately adjacent the throughflow regulator (3), comprising a plurality of openings (20) in a throughflow direction positioned downstream, in a flow direction, from the throughflow regulator (3) and the sieve, wherein the throughflow regulator (3) is contained within an interior space (6) of the unit (1) defined between the sieve (2) and the jet fractionating plate (4) and wherein the throughflow regulator (3) has the same general slope as the inner surface of the sieve (2).

2. The sanitary unit of claim 1, wherein the throughflow regulator (3) is arranged in the interior space (6) such that it sits on the jet fractionating plate (4) and is displaceable in an axial throughflow direction.

3. The sanitary unit of claim 2, wherein axial displacement of the throughflow regulator (3) within the interior space (6) is limited by the sieve (2), which is connected to the jet fractionating plate (4).

4. The sanitary unit of claim 1, wherein the throughflow regulator (3) is kept in place by the sieve (2), which is connected to the jet fractionating plate (4) by a press fit.

5. The sanitary unit of claim 1, wherein a ratio of an overall height of the sanitary unit (1) to a height of the interior space (6) is in a range of approximately 3:1 to 4:1.

6. The sanitary unit of claim 1, wherein the sanitary unit (1) has an overall height that is 3 to 4 times greater than a maximum height of the interior space (6).

7. The sanitary unit of claim 1, wherein the sanitary unit (1) has an overall height that is 3 times greater than a maximum height of the interior space (6).

8. A jet regulator (1), configured for insertion into a discharge fitting, comprising a conical upstream sieve (2) having and inner surface and an outer surface; a throughflow regulator (3) immediately adjacent the sieve (2), comprising a throttle body (8) and control gap (10) defining a passage leading to a jet fractionating plate (4), comprising a plurality of axial openings (20) in a downstream direction, positioned downstream in a flow direction from the sieve, wherein the throughflow regulator (3) is contained within an interior space (6) of the unit defined by an area delimited by the sieve in an upstream direction and the jet fractionating plate (4) in a downstream direction, the throughflow regulator (3) is kept in place by the sieve (2), which is connected the jet fractionating plate (4) by a press fit wherein the throughflow regulator (3) has the same general slope as an inner surface of the sieve (2).

9. The jet regulator (1) of claim 8, wherein the throughflow regulator (3) is arranged on the jet fractionating plate (4) and is prevented from axial movement by the sieve (2).

10. The jet regulator (1) of claim 8, wherein a ratio of an overall height of the jet regulator (1) to a maximum height of the interior space (6) is in a range of approximately 3:1 to 4:1.

11. The jet regulator (1) of claim 8, wherein the jet regulator (1) has an overall height that is 3 to 4 times greater than a maximum height of the interior space (6).

12. The jet regulator of claim 8, wherein the jet regulator (1) has an overall height that is 3 times greater than a maximum height of the interior space (6).

* * * * *